US011853004B2

(12) United States Patent
Kawabata et al.

(10) Patent No.: US 11,853,004 B2
(45) Date of Patent: Dec. 26, 2023

(54) ELECTROPHOTOGRAPHIC PHOTOCONDUCTOR, PROCESS CARTRIDGE, AND IMAGE FORMING APPARATUS

(71) Applicant: FUJIFILM Business Innovation Corp., Tokyo (JP)

(72) Inventors: Yukimi Kawabata, Ebina (JP); Keisuke Kusano, Ebina (JP); Hideya Katsuhara, Ebina (JP); Natsumi Kaneko, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/374,673

(22) Filed: Jul. 13, 2021

(65) Prior Publication Data

US 2022/0308474 A1 Sep. 29, 2022

(30) Foreign Application Priority Data

Mar. 26, 2021 (JP) ..... 2021-054280

(51) Int. Cl.

| | |
|---|---|
| ***G03G 5/06*** | (2006.01) |
| ***G03G 21/18*** | (2006.01) |
| ***G03G 5/05*** | (2006.01) |

(52) U.S. Cl.

CPC ..... *G03G 5/061443* (2020.05); *G03G 5/0564* (2013.01); *G03G 5/0609* (2013.01); *G03G 5/0696* (2013.01); *G03G 21/1803* (2013.01)

(58) Field of Classification Search

CPC ..... G03G 5/061443; G03G 5/0564; G03G 5/0609; G03G 5/0696; G03G 21/1803

See application file for complete search history.

(56) References Cited

U.S. PATENT DOCUMENTS

2017/0248855 A1 8/2017 Yamada

FOREIGN PATENT DOCUMENTS

| | | | |
|---|---|---|---|
| JP | 2007-187901 A | | 7/2007 |
| JP | 2016-66062 A | | 4/2016 |
| JP | 2017-156458 A | | 9/2017 |
| JP | 2019184810 A | * | 10/2019 |

OTHER PUBLICATIONS

English machine translation of the description of JP-2019184810-A (Year: 2019).*

* cited by examiner

*Primary Examiner* — Peter L Vajda
*Assistant Examiner* — Boone Alexander Evans
(74) *Attorney, Agent, or Firm* — Sughrue Mion, PLLC

(57) ABSTRACT

An electrophotographic photoconductor includes: a conductive substrate; and a single-layer-type photoconductive layer that is provided on the conductive substrate, contains a binder resin, a charge generating material, a hole transporting material, and an electron transporting material, and has an index A represented by the following equation (1) in a range of −7.98 or more and −7.28 or less, Equation (1): $A=(0.057\times M)-(0.002\times F)-(0.252\times\mu)$, in which, in the equation (1), M represents a Martens hardness of the single-layer-type photoconductive layer, F represents a Young's modulus of the single-layer-type photoconductive layer, and μ represents an elastic deformation ratio of the single-layer-type photoconductive layer.

15 Claims, 3 Drawing Sheets

ELECTROPHOTOGRAPHIC PHOTOCONDUCTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2021-054280 filed on Mar. 26, 2021.

BACKGROUND

Technical Field

The present invention relates to an electrophotographic photoconductor, a process cartridge, and an image forming apparatus.

Related Art

In a related-art electrophotographic image forming apparatus, a toner image formed on a surface of an electrophotographic photoconductor is transferred onto a recording medium through steps of charging, electrostatic latent image formation, development, and transfer.

For example, JP-A-2017-156458 discloses "a photoconductor including a charge generating material containing gallium phthalocyanine and having a Martens hardness of 170 N/mm$^2$ or more and 200 N/mm$^2$ or less".

Further, JP-A-2016-066062 discloses "an electrophotographic photoconductor including: a conductive substrate; and a single-layer-type photoconductive layer provided on the conductive substrate, the photoconductive layer containing a binder resin, a charge generating material, a hole transporting material, and a specific electron transporting material, in which an elastic deformation ratio R is 0.340 or more and 0.360 or less".

Further, JP-A-2007-187901 discloses "an electrophotographic photoconductor, in which when a hardness of the electrophotographic photoconductor is tested using a Vickers quadrangular pyramid diamond indenter, a universal hardness value (HU) when the indenter is pressed with a load of 6 mN is 150 N/mm$^2$ or more and 220 N/mm$^2$ or less, and an elastic deformation ratio is 50% or more and 65% or less, and further, a support includes an insert inside".

SUMMARY

Aspects of non-limiting embodiments of the present disclosure relate to an electrophotographic photoconductor, in which occurrence of color spots is prevented while reducing wear of a photoconductive layer, as compared with a case of an electrophotographic photoconductor including a single-layer-type photoconductive layer containing a binder resin, a charge generating material, a hole transporting material, and an electron transporting material, and having an index A represented by the following equation (1) of less than −7.98 or more than −7.28.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrophotographic photoconductor including:

a conductive substrate; and a single-layer-type photoconductive layer that is provided on the conductive substrate, contains a binder resin, a charge generating material, a hole transporting material, and an electron transporting material, and has an index A represented by the following equation (1) in a range of −7.98 or more and −7.28 or less, $$A=(0.057\times M)-(0.002\times F)-(0.252\times \mu) \quad \text{Equation (1):}$$

in the equation (1), M represents a Martens hardness of the single-layer-type photoconductive layer, F represents a Young's modulus of the single-layer-type photoconductive layer, and μ represents an elastic deformation ratio of the single-layer-type photoconductive layer.

BRIEF DESCRIPTION OF THE DRAWINGS

Exemplary embodiment(s) of the present invention will be described in detail based on the following figures, wherein.

DETAILED DESCRIPTION

Figure 1:
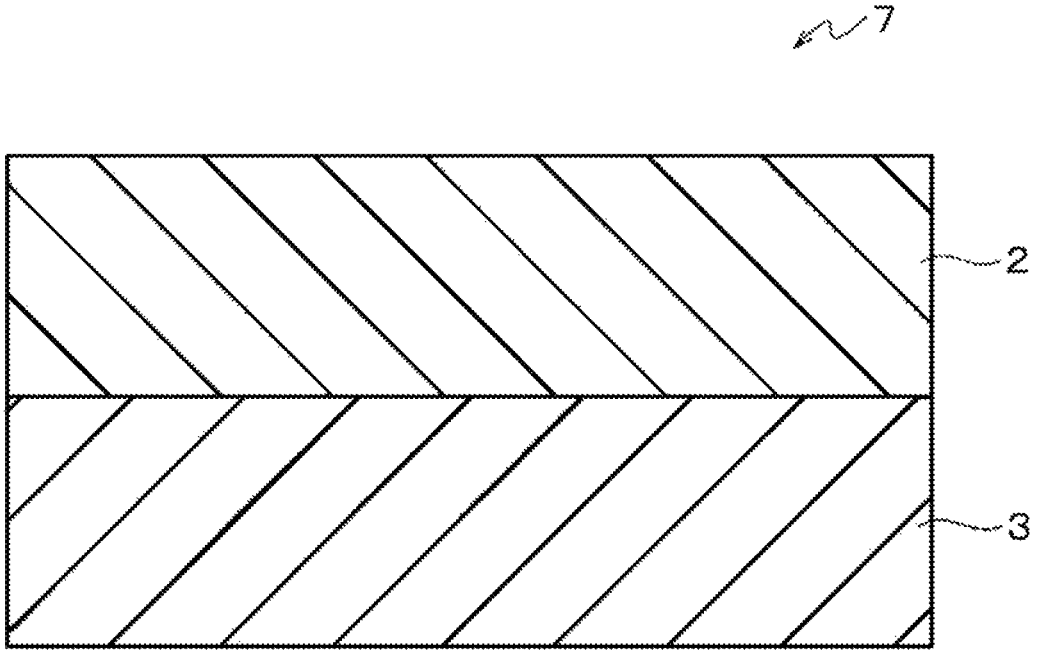
FIG. 1 is a schematic partial cross-sectional view illustrating an example of a layer configuration of an electrophotographic photoconductor according to a present exemplary embodiment.

Hereinafter, an exemplary embodiment as an example of the present invention will be described in detail.

In the numerical ranges described in stages in the present description, an upper limit or a lower limit described in one numerical range may be replaced with an upper limit or a lower limit of the numerical range described in other stages. Further, in the numerical ranges described in the present description, the upper limit or the lower limit of the numerical range may be replaced with values shown in Examples.

In the present description, the term "step" indicates not only an independent step, and even when a step cannot be clearly distinguished from other steps, this step is included in the term "step" as long as the intended purpose of the step is achieved.

Each component may contain plural kinds of corresponding substances.

In a case of referring to an amount of each component, when there are plural kinds of substances corresponding to each component, unless otherwise specified, it refers to a total amount of the plural kinds of substances.

An electrophotographic photoconductor having a single-layer-type photoconductive layer is also referred to as a "single-layer-type photoconductor". A single-layer-type photoconductive layer is a photoconductive layer having a hole transporting property and an electron transporting property as well as a charge generating ability.

Electrophotographic Photoconductor

An electrophotographic photoconductor according to the present exemplary embodiment includes a conductive substrate, and a single-layer-type photoconductive layer that is provided on the conductive substrate and contains a binder resin, a charge generating material, a hole transporting material, and an electron transporting material.

An index A represented by the following equation (1) of the photoconductive layer is in a range of −7.98 or more and −7.28 or less.

$$A=(0.057\times M)-(0.002\times F)-(0.252\times\mu) \quad \text{Equation (1):}$$

In the equation (1), M represents a Martens hardness of the photoconductive layer, F represents a Young's modulus of the photoconductive layer, and μ represents an elastic deformation ratio of the photoconductive layer.

Here, in the electrophotographic photoconductor, wear resistance of the photoconductive layer is required from the viewpoint of improving a lifetime. On the other hand, when paper debris or the like is likely to adhere to the photoconductive layer and a cleaning property is low, color spots caused by adhesive materials may occur.

In contrast, in the electrophotographic photoconductor according to the present exemplary embodiment, the wear resistance is improved by the index A of the photoconductive layer satisfying the above range. In addition, the paper debris or the like is unlikely to adhere to the photoconductive layer, and the cleaning property of the photoconductive layer is improved.

Therefore, the electrophotographic photoconductor according to the present exemplary embodiment prevents the occurrence of the color spots while reducing wear of the photoconductive layer.

Hereinafter, the electrophotographic photoconductor according to the present exemplary embodiment will be described in detail.

In the electrophotographic photoconductor according to the present exemplary embodiment, the index A of the photoconductive layer is in the range of −7.98 or more and −7.28 or less, and is preferably in a range of −7.89 or more and −7.30 or less, and more preferably in a range of −7.80 or more and −7.34 or less, from the viewpoints of improving the wear resistance and preventing the occurrence of the color spots.

In order to set the index A in the above range, control is performed by, for example, the following:

1) types of the hole transporting material (preferably, a hole transporting material having a benzidine skeleton is used);
2) types of the electron transporting material (preferably, an electron transporting material having a diphenoquinone skeleton is used); and
3) types and molecular weights of the binder resin (preferably a polycarbonate resin is used).

The Martens hardness M of the photoconductive layer is preferably 160 N/mm$^2$ or more and 240 N/mm$^2$ or less, more preferably 170 N/mm$^2$ or more and 230 N/mm$^2$ or less, and still more preferably 180 N/mm$^2$ or more and 225 N/mm$^2$ or less, from the viewpoints of improving the wear resistance and preventing the occurrence of the color spots.

The Young's modulus F of the photoconductive layer is preferably 3500 MPa or more and 4900 MPa or less, more preferably 3700 MPa or more and 4800 MPa or less, and still more preferably 4000 MPa or more and 4700 MPa or less, from the viewpoints of improving the wear resistance and preventing the occurrence of the color spots.

The elastic deformation ratio μ of the photoconductive layer is preferably 35% or more and 50% or less, more preferably 38% or more and 48% or less, and still more preferably 40% or more and 45% or less, from the viewpoints of improving the wear resistance and preventing the occurrence of the color spots.

Here, the Martens hardness, the Young's modulus, and the elastic deformation ratio of the photoconductive layer are values measured when an indenter is pressed into a surface of a photoconductor (that is, a photoconductive layer). A specific measurement method is as follows.

First, a photoconductor having a photoconductive layer to be measured is set in a measurement device (PICODENTOR HM500) manufactured by Fisher Instruments under an environment of a temperature of 23° C. and 30% RH. Then, a load is continuously increased with respect to a surface of the photoconductor (that is, the photoconductive layer) by using a Vickers indenter, and each physical property (Martens hardness, Young's modulus, and elastic deformation ratio) measured when the indenter is pressed in 0.5 μm is obtained.

There are five measurement points: positions 40 mm from both ends, positions 80 mm from both ends, and a central part. An average value of the measured values at these five points is taken as a physical property value of each.

Martens Hardness of Photoconductive Layer

The Martens hardness of the photoconductive layer is obtained by dividing a test load by a surface area of the indenter when the indenter is pressed under the above conditions.

Young's Modulus of Photoconductive Layer

The Young's modulus of the photoconductive layer is obtained by measuring a pressing depth-load curve when the indenter is pressed under the above conditions, applying a load at a maximum pressing depth of 500 nm, and subsequently calculating a slope of an unloading curve when the load is unloaded as the Young's modulus.

Elastic Deformation Ratio of Photoconductive Layer

The elastic deformation ratio of the photoconductive layer is obtained by measuring a displacement amount to an apex of a load and a displacement return amount after the load is released when the indenter is pressed under the above conditions, and calculating a ratio thereof as the elastic deformation ratio of the photoconductive layer.

Next, the electrophotographic photoconductor according to the present exemplary embodiment will be described in detail with reference to the drawings.

FIG. 1 schematically illustrates a cross section of a part of an electrophotographic photoconductor 7 according to the present exemplary embodiment.

The electrophotographic photoconductor 7 illustrated in FIG. 1 includes, for example, a conductive substrate 3 and a single-layer-type photoconductive layer 2, as an outermost layer, provided on the conductive substrate 3.

Other layers may be provided as necessary. Examples of the other layers include an undercoat layer provided between the conductive substrate 3 and the single-layer-type photoconductive layer 2.

Hereinafter, each layer of the electrophotographic photoconductor according to the present exemplary embodiment will be described in detail. In the following description, reference numerals will be omitted.

Conductive Substrate

Examples of the conductive substrate include a metal plate, a metal drum, and a metal belt containing a metal (aluminum, copper, zinc, chromium, nickel, molybdenum, vanadium, indium, gold, platinum, etc.) or an alloy (stainless steel, etc.). Further, examples of the conductive substrate include paper, a resin film, and a belt coated, deposited, or laminated with a conductive compound (a conductive polymer, indium oxide, etc.), a metal (aluminum, palladium, gold, etc.), or an alloy. Here, the expression "conductive" means that a volume resistivity is less than $10^{13}$ Ω·cm.

When the electrophotographic photoconductor is used in a laser printer, a surface of the conductive substrate is preferably roughened to a center line average roughness Ra of 0.04 μm or more and 0.5 μm or less for the purpose of preventing interference fringes generated when irradiating with a laser beam. When a non-interfering light is used as a light source, the roughening for preventing the interference fringes is not particularly necessary, but the roughening prevents occurrence of defects due to unevenness of the surface of the conductive substrate, and thus is suitable for extending a lifetime.

Examples of a roughening method include wet honing performed by suspending an abrasive in water and spraying the obtained suspension onto a support, centerless grinding in which a conductive substrate is pressed against a rotating grinding stone to perform continuous grinding, and an anodizing treatment.

Examples of the roughening method also include a method of roughening by dispersing a conductive or semi-conductive powder in a resin, then forming a layer on a surface of a conductive substrate, and dispersing particles in the layer, without roughening the surface of the conductive substrate.

In a roughening treatment by anodizing, by anodizing, in an electrolyte solution, a conductive substrate made of a metal (for example, made of aluminum) as an anode, a porous anodic oxide film is formed on the surface of the conductive substrate. Examples of the electrolyte solution include a sulfuric acid solution and an oxalic acid solution. However, the porous anodic oxide film formed by anodizing is chemically active in a state as it is, is easily contaminated, and has a large resistance variation depending on an environment. Therefore, it is preferable to perform, on the porous anodic oxide film, a pore-sealing treatment in which fine pores of the oxide film are sealed by volume expansion due to a hydration reaction in pressurized water vapor or boiling water (in which a salt of a metal such as nickel may be added), and the oxide film is changed to a more stable hydrated oxide.

A film thickness of the anodic oxide film is preferably 0.3 μm or more and 15 μm or less, for example. When the film thickness is within the above range, a barrier property against injection tends to be exhibited, and an increase in residual potentials due to repeated use tends to be prevented.

The conductive substrate may be subjected to a treatment with an acidic treatment solution or a boehmite treatment.

The treatment with the acidic treatment solution is performed, for example, as follows. Firstly, an acidic treatment solution containing phosphoric acid, chromic acid, and hydrofluoric acid is prepared. A blending ratio of the phosphoric acid, the chromic acid, and the hydrofluoric acid in the acidic treatment solution may be: for example, the phosphoric acid in a range of 10 mass % or more and 11 mass % or less, the chromic acid in a range of 3 mass % or more and 5 mass % or less, and the hydrofluoric acid in a range of 0.5 mass % or more and 2 mass % or less, and a concentration of all the acids as a whole may be in a range of 13.5 mass % or more and 18 mass % or less. A treatment temperature is preferably 42° C. or higher and 48° C. or lower, for example. A film thickness of a coating film formed by the treatment with the acidic treatment solution is preferably 0.3 μm or more and 15 μm or less.

The boehmite treatment is performed, for example, by immersing the conductive substrate in pure water at 90° C. or higher and 100° C. or lower for 5 minutes to 60 minutes, or bringing the conductive substrate into contact with heated water vapor at 90° C. or higher and 120° C. or lower for 5 minutes to 60 minutes. A film thickness of a coating film formed by the boehmite treatment is preferably 0.1 μm or more and 5 μm or less. The conductive substrate subjected to the boehmite treatment may be further anodized with an electrolyte solution having a low solubility of a coating film, such as a solution of an adipic acid, a boric acid, a borate, a phosphate, a phthalate, a maleate, a benzoate, a tartrate, or a citrate.

Single-Layer-Type Photoconductive Layer

The single-layer-type photoconductive layer contains a binder resin, a charge generating material, a hole transporting material, and an electron transporting material. The single-layer-type photoconductive layer may contain other additives as necessary. Hereinafter, each component included in the single-layer-type photoconductive layer will be described in detail.

Binder Resin

The binder resin is not particularly limited, and examples thereof include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, and polysilane.

These binder resins may be used alone or in combination of two or more thereof.

Among the binder resins, from the viewpoints of improving the wear resistance and preventing the occurrence of the color spots, a polycarbonate resin is preferred, and a polycarbonate resin containing at least one of a structural unit represented by the following general formula (PCA) and a structural unit represented by the following general formula (PCB) is particularly preferred.

(PCA)

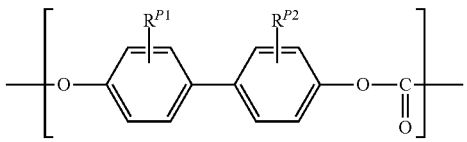

(PCB)

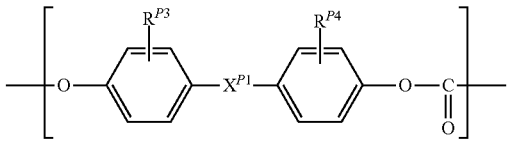

In the general formulas (PCA) and (PCB), $R^{P1}$, $R^{P2}$, $R^{P3}$, and $R^{P4}$ each independently represent a hydrogen atom, a halogen atom, an alkyl group having 1 or more and 6 or less carbon atoms, a cycloalkyl group having 5 or more and 7 or less carbon atoms, or an aryl group having 6 or more and 12 or less carbon atoms, and $X^{P1}$ represents a phenylene group, a biphenylene group, a naphthylene group, an alkylene group, or a cycloalkylene group.

In the general formulas (PCA) and (PCB), examples of the alkyl group represented by $R^{P1}$, $R^{P2}$, $R^{P3}$, and $R^{P4}$ include a linear or branched alkyl group having 1 or more and 6 or less carbon atoms (preferably 1 or more and 3 or less carbon atoms).

Specific examples of the linear alkyl group include a methyl group, an ethyl group, an n-propyl group, an n-butyl group, an n-pentyl group, and an n-hexyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, and a tert-hexyl group.

Among these, the alkyl group is preferably a lower alkyl group such as a methyl group or an ethyl group.

In the general formulas (PCA) and (PCB), examples of the cycloalkyl group represented by $R^{P1}$, $R^{P2}$, $R^{P3}$, and $R^{P4}$ include cyclopentyl, cyclohexyl, and cycloheptyl.

In the general formulas (PCA) and (PCB), examples of the aryl group represented by $R^{P1}$, $R^{P2}$, $R^{P3}$, and $R^{P4}$ include a phenyl group, a naphthyl group, and a biphenylyl group.

In the general formulas (PCA) and (PCB), examples of the alkylene group represented by $X^{P1}$ include a linear or branched alkylene group having 1 or more and 12 or less carbon atoms (preferably 1 or more and 6 or less carbon atoms, and more preferably 1 or more and 3 or less carbon atoms).

Specific examples of the linear alkylene group include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, and an n-dodecylene group.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, and a neododecylene group.

Among these, the alkylene group is preferably a lower alkyl group such as a methylene group, an ethylene group, or a butylene group.

In the general formulas (PCA) and (PCB), examples of the cycloalkylene group represented by $X^{P1}$ include a cycloalkylene group having 3 or more and 12 or less carbon atoms (preferably 3 or more and 10 or less carbon atoms, and more preferably 5 or more and 8 or less carbon atoms).

Specific examples of the cycloalkylene group include a cyclopropylene group, a cyclopentylene group, a cyclohexylene group, a cyclooctylene group, and a cyclododecanylene group.

Among these, the cycloalkylene group is preferably a cyclohexylene group.

In the general formulas (PCA) and (PCB), each of the above substituents represented by $R^{P1}$, $R^{P2}$, $R^{P3}$, $R^{P4}$, and $X^{P1}$ further includes a group having a substituent. Examples of the substituent include a halogen atom (for example, a fluorine atom and a chlorine atom), an alkyl group (for example, an alkyl group having 1 or more and 6 or less carbon atoms), a cycloalkyl group (for example, a cycloalkyl group having 5 or more and 7 or less carbon atoms), an alkoxy group (for example, an alkoxy group having 1 or more and 4 or less carbon atoms), and an aryl group (for example, a phenyl group, a naphthyl group, and a biphenylyl group).

In the general formula (PCA), $R^{P1}$ and $R^{P2}$ each independently preferably represent a hydrogen atom or an alkyl group having 1 or more and 6 or less carbon atoms, and more preferably, $R^{P1}$ and $R^{P2}$ each represent a hydrogen atom.

In the general formula (PCB), $R^{P3}$ and $R^{P4}$ each independently preferably represent a hydrogen atom or an alkyl group having 1 or more and 6 or less carbon atoms, and preferably, $X^{P1}$ represents an alkylene group or a cycloalkylene group.

Specific examples of the structural unit represented by the general formula (PCA) and the structural unit represented by the general formula (PCB) include, but are not limited to, the following.

(PCA-1)

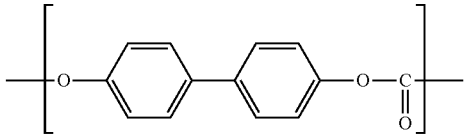

(PCB-1)

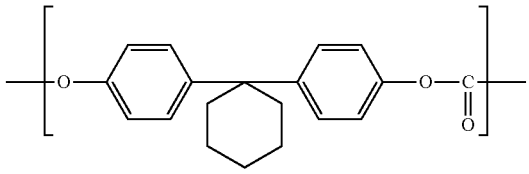

(PCB-2)

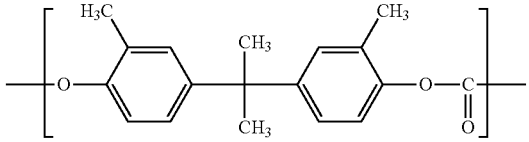

(PCB-3)

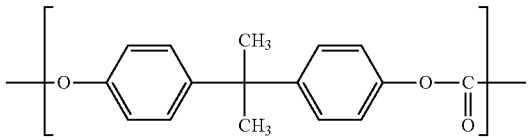

Further, the binder resin is more preferably a polycarbonate resin containing both the structural unit represented by general formula (PCA) and the structural unit represented by the general formula (PCB).

Specific examples of the polycarbonate resin containing both the structural unit represented by the general formula (PCA) and the structural unit represented by the general formula (PCB) include, but are not limited to, the following. In the exemplified compounds, "pm" and "pn" represent a copolymerization ratio.

(PC-1)

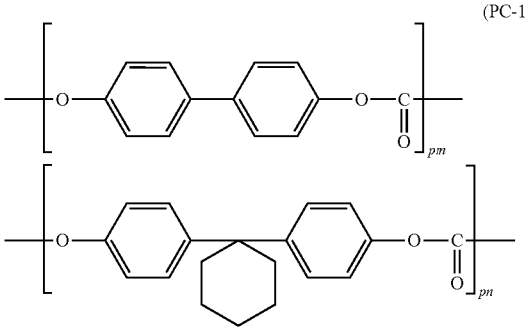

(PC-2)

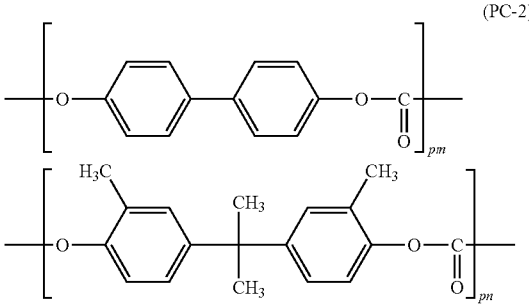

(PC-3)

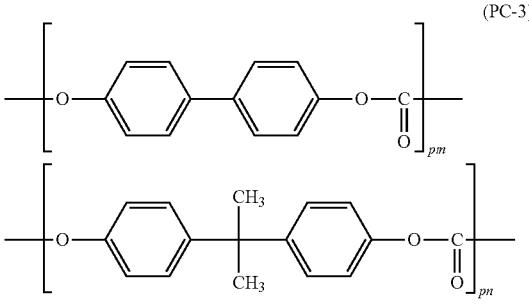

In the polycarbonate resin containing both the structural unit represented by the general formula (PCA) and the structural unit represented by the general formula (PCB), a content ratio (copolymerization ratio) of the structural unit represented by the general formula (PCA) may be in a range of 5 mol % or more and 95 mol % or less, and, from the viewpoint of enhancing the wear resistance of the photoconductive layer (including a charge transport layer), is preferably in a range of 5 mol % or more and 50 mol % or less, and still more preferably in a range of 15 mol % or more and 30 mol % or less with respect to all structural units constituting the polycarbonate resin.

Specifically, in the above exemplified compounds of the polycarbonate resin, pm and pn represent the copolymerization ratio (molar ratio), and pm:pn is preferably a range of 95:5 to 5:95, more preferably a range of 50:50 to 5:95, and still more preferably a range of 15:85 to 30:70.

When the polycarbonate resin containing at least one of the structural unit represented by the general formula (PCA) and the structural unit represented by the general formula (PCB) is used in combination with another binder resin, a content of the another binder resin may be 10 mass % or less (preferably 5 mass % or less) with respect to the total binder resin.

A content of the binder resin with respect to the total solid content of the photoconductive layer may be 35 mass % or more and 60 mass % or less, and preferably 40 mass % or more and 55 mass % or less.

The binder resin described above preferably has the following aspects from the viewpoints of improving the wear resistance and preventing the occurrence of the color spots.

1) An aspect in which a homopolymerization type polycarbonate resin having a weight average molecular weight of 20,000 or more and 70,000 or less and having only the structural unit represented by the general formula (PCB) is contained in an amount of 40 mass % or more and 60 mass % or less with respect to the photoconductive layer.

2) An aspect in which a mixture of a copolymerization type polycarbonate resin having a weight average molecular weight of 40,000 or more and 60,000 or less and containing both the structural unit represented by the general formula (PCA) and the structural unit represented by the general formula (PCB), and a homopolymerization type polycarbonate resin having a weight average molecular weight of 20,000 or more and 40,000 or less and having only the structural unit represented by the general formula (PCB) is contained in a mass ratio (a mass of the copolymerization type polycarbonate resin/a mass of the homopolymerization type polycarbonate resin) of 0.25 or more and 4 or less, and in an amount of 40 mass % or more and 55 mass % or less with respect to the photoconductive layer.

The weight average molecular weight is measured by gel permeation chromatography (GPC). A molecular weight measurement by GPC is performed by using a GPC•HLC-8120 manufactured by Tosoh Corporation as a measurement device, using a column TSKgel Super HM-M (15 cm) manufactured by Tosoh Corporation, and using a THF solvent. The weight average molecular weight and a number average molecular weight are calculated from a measurement result by using a molecular weight calibration curve prepared using a monodisperse polystyrene standard sample.

Charge Generating Material

Examples of the charge generating material include an azo pigment such as bisazo and trisazo, a condensed-ring aromatic pigment such as dibromoanthanthrone, a perylene pigment, a pyrrolopyrrole pigment, a phthalocyanine pigment, zinc oxide, and trigonal selenium.

Among these, in order to cope with laser exposure in a near-infrared region, it is preferable to use a metal phthalocyanine pigment or a metal-free phthalocyanine pigment as the charge generating material. Specifically, the charge generating material is, for example, more preferably hydroxygallium phthalocyanine disclosed in JP-A-H05-263007, JP-A-H05-279591, etc., chlorogallium phthalocyanine disclosed in JP-A-H05-98181, etc., dichlorotin phthalocyanine disclosed in JP-A-H05-140472, JP-A-H05-140473, etc., and titanyl phthalocyanine disclosed in JP-A-H04-189873, etc.

Meanwhile, in order to cope with laser exposure in a near-ultraviolet region, the charge generating material is preferably a condensed-ring aromatic pigment such as dibromoanthanthrone, a thioindigo pigment, a porphyrazine compound, zinc oxide, trigonal selenium, and a bisazo pigment disclosed in JP-A-2004-78147 and JP-A-2005-181992.

That is, the charge generating material is, for example, preferably an inorganic pigment when a light source having an exposure wavelength of 380 nm or more and 500 nm or less is used, and preferably a metal phthalocyanine pigment and a metal-free phthalocyanine pigment when a light source having an exposure wavelength of 700 nm or more and 800 nm or less is used.

Here, the charge generating material is preferably at least one selected from a hydroxygallium phthalocyanine pigment and a chlorogallium phthalocyanine pigment, and more preferably a hydroxygallium phthalocyanine pigment, from the viewpoint of achieving a high sensitivity of the single-layer-type photoconductor.

The hydroxygallium phthalocyanine pigment is not particularly limited, and a V-type hydroxygallium phthalocyanine pigment may be used.

In particular, the hydroxygallium phthalocyanine pigment is, for example, desirably a hydroxygallium phthalocyanine pigment having a maximum peak wavelength in a range of 810 nm or more and 839 nm or less in a spectral absorption spectrum in a wavelength region of 600 nm or more and 900 nm or less, from the viewpoint of obtaining more excellent dispersibility. When the hydroxygallium phthalocyanine pigment is used as a material of the electrophotographic photoconductor, excellent dispersibility, sufficient sensitivity, chargeability, and dark attenuation characteristics may be easily obtained.

Further, the above hydroxygallium phthalocyanine pigment having a maximum peak wavelength in a range of 810 nm or more and 839 nm or less desirably has an average particle diameter in a specific range and a BET specific surface area in a specific range. Specifically, the average particle diameter is desirably 0.20 μm or less, and more desirably 0.01 μm or more and 0.15 μm or less, and the BET specific surface area is desirably 45 $m^2/g$ or more, more desirably 50 $m^2/g$ or more, and particularly desirably 55 $m^2/g$ or more and 120 $m^2/g$ or less. The average particle diameter is a volume average particle diameter (d50 average particle diameter), and is a value measured by a laser diffraction and scattering particle size distribution measurement device (LA-700, manufactured by Horiba, Ltd.). Further, the BET specific surface area is a value measured by a nitrogen substitution method using a BET type specific surface area measuring apparatus (FlowSorb II 2300, manufactured by Shimadzu Corporation).

Here, when the average particle diameter is larger than 0.20 μm or the BET specific surface area value is less than 45 $m^2/g$, pigment particles tend to be coarsened or aggregates of the pigment particles tend to be formed, and defects tend to occur in characteristics such as dispersibility, sensitivity, chargeability, and dark attenuation characteristics, which may lead to image quality defects.

A maximum particle diameter (that is, a maximum value of a primary particle diameter) of the hydroxygallium phthalocyanine pigment is desirably 1.2 μm or less, more desirably 1.0 μm or less, and still more desirably 0.3 μm or less. When the maximum particle diameter exceeds the above range, black spots are likely to occur.

The hydroxygallium phthalocyanine pigment desirably has an average particle diameter of 0.2 μm or less, a maximum particle diameter of 1.2 μm or less, and a BET specific surface area value of 45 $m^2/g$ or more, from the viewpoint of preventing density unevenness caused by exposure of the photoconductor to a fluorescent lamp or the like.

The hydroxygallium phthalocyanine pigment is desirably a V-type one having diffraction peaks at Bragg angles (2θ±0.2°) of at least 7.3°, 16.0°, 24.9°, and 28.0° in an X-ray diffraction spectrum using CuKα characteristic X-rays.

Meanwhile, the chlorogallium phthalocyanine pigment is, for example, desirably one having diffraction peaks at Bragg angles (2θ±0.2°) of 7.4°, 16.6°, 25.5°, and 28.3°, at which excellent sensitivity is obtained for an electrophotographic photoconductor material.

A maximum peak wavelength of a suitable spectral absorption spectrum, an average particle diameter, a maximum particle diameter, and a BET specific surface area value of the chlorogallium phthalocyanine pigment are the same as those of the hydroxygallium phthalocyanine pigment.

A content of the charge generating material with respect to the total solid content of the photoconductive layer may be 1 mass % or more and 5 mass % or less, and preferably 1.2 mass % or more and 4.5 mass % or less.

Hole Transporting Material

The hole transporting material is not particularly limited, and examples thereof include: an oxadiazole derivative such as 2,5-bis(p-diethylaminophenyl)-1,3,4-oxadiazole; a pyrazoline derivative such as 1,3,5-triphenyl-pyrazoline and 1-[pyridyl-(2)]-3-(p-diethylaminostyryl)-5-(p-diethylaminostyryl) pyrazoline; an aromatic tertiary amino compound such as triphenylamine, N,N'-bis(3,4-dimethylphenyl)biphenyl-4-amine, tri(p-methylphenyl)aminyl-4-amine, and dibenzylaniline; an aromatic tertiary diamino compound such as N,N'-bis(3-methylphenyl)-N,N'-diphenylbenzidine; a 1,2,4-triazine derivative such as 3-(4'-dimethylaminophenyl)-5,6-di-(4'-methoxyphenyl)-1,2,4-triazine; a hydrazone derivative such as 4-diethylaminobenzaldehyde-1,1-diphenylhydrazone; a quinazoline derivative such as 2-phenyl-4-styryl-quinazoline; a benzofuran derivative such as 6-hydroxy-2,3-di(p-methoxyphenyl)benzofuran; an α-stilbene derivative such as p-(2,2-diphenylvinyl)-N,N-diphenylaniline; an enamine derivative; a carbazole derivative such as N-ethylcarbazole; a poly-N-vinylcarbazole and a derivative thereof; and a polymer having a group in the main chain or the side chain and composed of the above compounds. These hole transporting materials may be used alone or in combination of two or more thereof.

Among these, examples of the hole transporting material suitably include a triarylamine-based hole transporting material represented by the following general formula (HT1), and a hole transporting material having a benzidine skeleton to be described later.

Triarylamine-Based Hole Transporting Material (HT1)

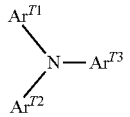

In the general formula (HT1), $Ar^{T1}$, $Ar^{T2}$, and $Ar^{T3}$ each independently represent an aryl group or $—C_6H_4—C(R^{T4})=C(R^{T5})(R^{T6})$. $R^{T4}$, $R^{T5}$, and $R^{T6}$ each independently represent a hydrogen atom, an alkyl group, or an aryl group. $R^{T5}$ and $R^{T6}$ may combine to form a hydrocarbon ring structure.

In the general formula (HT1), examples of the aryl group represented by $Ar^{T1}$, $Ar^{T2}$, and $Ar^{T3}$ include an aryl group having 6 or more and 15 or less (preferably 6 or more and 9 or less, and more preferably 6 or more and 8 or less) carbon atoms.

Specific examples of the aryl group include a phenyl group, a naphthyl group, and a fluorene group.

Among these, the aryl group is preferably a phenyl group.

In the general formula (HT1), examples of the alkyl group represented by $R^{T4}$, $R^{T5}$, and $R^{T6}$ are the same as examples of an alkyl group represented by $R^{C21}$, $R^{C22}$, and $R^{C23}$ in the general formula (HT1a) to be described later, and preferred ranges are also the same.

In the general formula (HT1), examples of the aryl group represented by $R^{T4}$, $R^{T5}$, and $R^{T6}$ are the same as the examples of the aryl group represented by $Ar^{T1}$, $Ar^{T2}$, and $Ar^{T3}$, and preferred ranges are also the same.

In the general formula (HT1), each of the above substituents represented by $Ar^{T1}$, $Ar^{T2}$, $Ar^{T3}$, $R^{T4}$, $R^{T5}$, and $R^{T6}$ further include a group having a substituent. Examples of the substituent include a halogen atom, an alkyl group having 1 or more and 5 or less carbon atoms, an alkoxy group having 1 or more and 5 or less carbon atoms, and an aryl group having 6 or more and 10 or less carbon atoms. Further, examples of the substituent of each of the above substituents include a substituted amino group substituted with an alkyl group having 1 or more and 3 or less carbon atoms.

A triarylamine-based hole transporting material (HT1) may be used alone or in combination of two or more thereof.

Here, from the viewpoint of charge mobility, among the triarylamine-based hole transporting materials represented by the general formula (HT1), the triarylamine-based hole transporting material is particularly preferably one having "$—C_6H_4—C(R^{T4})=C(R^{T5})(R^{T6})$". Among these, the triarylamine-based hole transporting material is preferably one represented by a specific example (HT1-4) of a triarylamine-based hole transporting material (HT1) to be described later.

Benzidine-Based Hole Transporting Material

The hole transporting material having the benzidine skeleton is particularly preferred as the hole transporting material from the viewpoints of improving the wear resistance and preventing the occurrence of the color spots. The hole transporting material having the benzidine skeleton is more preferably a benzidine-based hole transporting material represented by the following general formula (HT1a).

(HT1a)

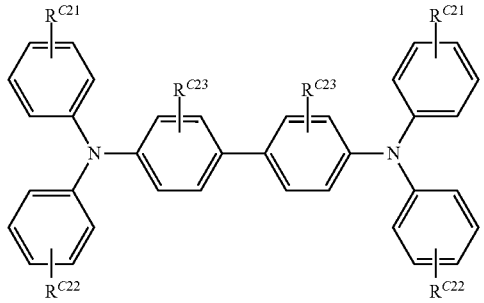

In the general formula (HT1a), $R^{C21}$, $R^{C22}$, and $R^{C23}$ each independently represent a hydrogen atom, a halogen atom, an alkyl group having 1 or more and 10 or less carbon atoms, an alkoxy group having 1 or more and 10 or less carbon atoms, or an aryl group having 6 or more and 10 or less carbon atoms.

In the general formula (HT1a), examples of the halogen atom represented by $R^{C21}$, $R^{C22}$, and $R^{C23}$ include a fluorine atom, a chlorine atom, a bromine atom, and an iodine atom. Among these, the halogen atom is preferably a fluorine atom or a chlorine atom, and more preferably a chlorine atom.

In the general formula (HT1a), examples of the alkyl group represented by $R^{C21}$, $R^{C22}$, and $R^{C23}$ include a linear or branched alkyl group having 1 or more and 10 or less (preferably 1 or more and 6 or less, and more preferably 1 or more and 4 or less) carbon atoms.

Specific examples of the linear alkyl group include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, the alkyl group is preferably a lower alkyl group such as a methyl group, an ethyl group, or an isopropyl group.

In the general formula (HT1a), examples of the alkoxy group represented by $R^{C21}$, $R^{C22}$, and $R^{C23}$ include a linear or branched alkoxy group having 1 or more and 10 or less (preferably 1 or more and 6 or less, and more preferably 1 or more and 4 or less) carbon atoms.

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, and an n-decyloxy group.

Specific examples of the branched alkoxy group include an isopropoxy group, an isobuthoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, the alkoxy group is preferably a methoxy group.

In the general formula (HT1a), examples of the aryl group represented by $R^{C21}$, $R^{C22}$, and $R^{C23}$ include an aryl group having 6 or more and 10 or less (preferably 6 or more and 9 or less, and more preferably 6 or more and 8 or less) carbon atoms.

Specific examples of the aryl group include a phenyl group and a naphthyl group.

Among these, the aryl group is preferably a phenyl group.

In the general formula (HT1a), each of the above substituents represented by $R^{C21}$, $R^{C22}$, and $R^{C23}$ further includes a group having a substituent. Examples of the substituent include the atoms and the groups as exemplified above (for example, a halogen atom, an alkyl group, an alkoxy group, and an aryl group).

The benzidine-based hole transporting material represented by the general formula (HT1a) may be used alone or in combination of two or more thereof.

Hereinafter, specific examples (HT1-1) to (HT1-10) of the triarylamine-based hole transporting material (HT1) and the benzidine-based hole transporting material (HT1a) are shown, but the triarylamine-based hole transporting material (HT1) and the benzidine-based hole transporting material (HT1a) are not limited thereto.

HT1-1
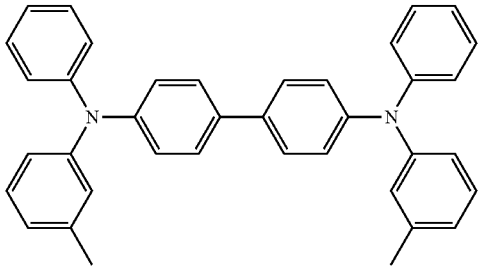
HT1-2
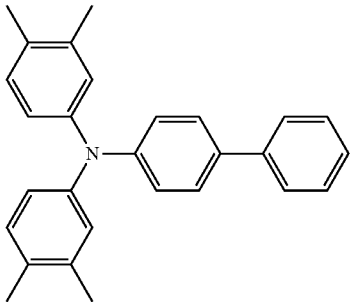
HT1-3
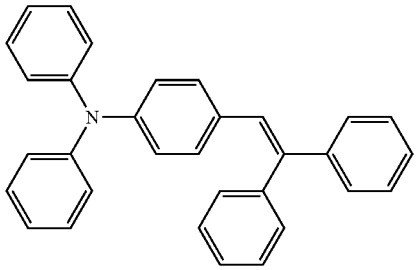
HT1-4
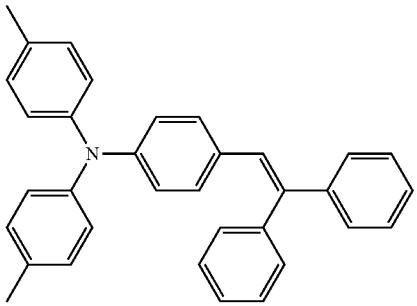
HT1-5
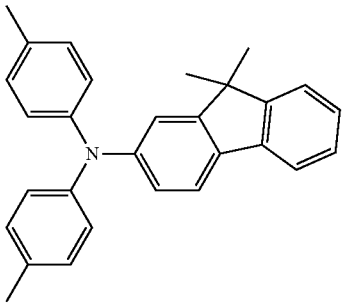
HT1-6
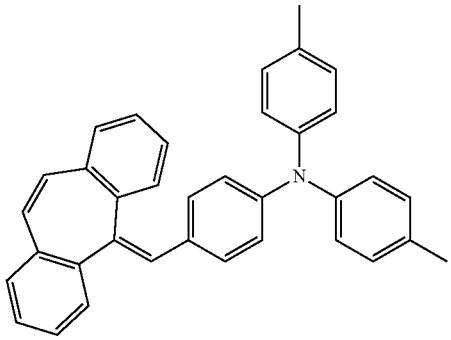
HT1-7
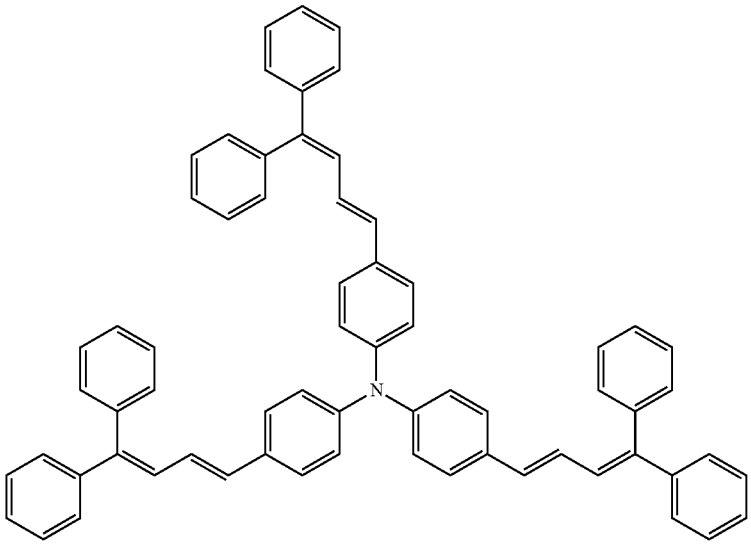

-continued

HT1-8

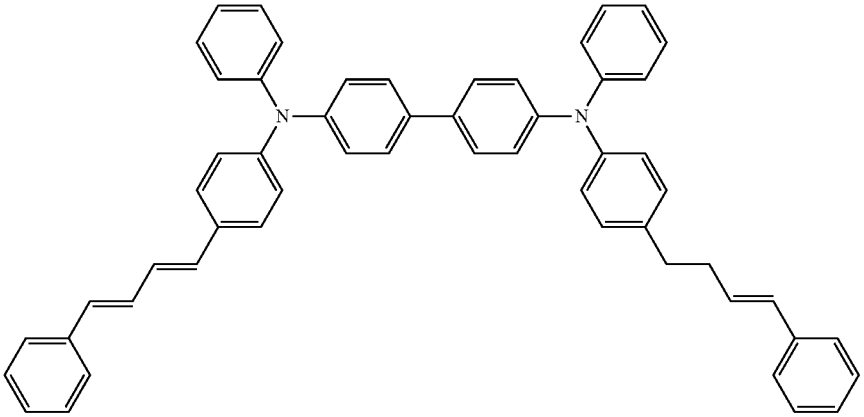

HT1-9

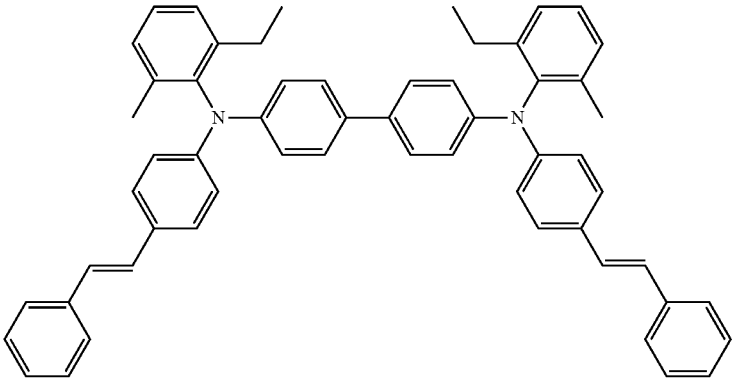

HT1-10

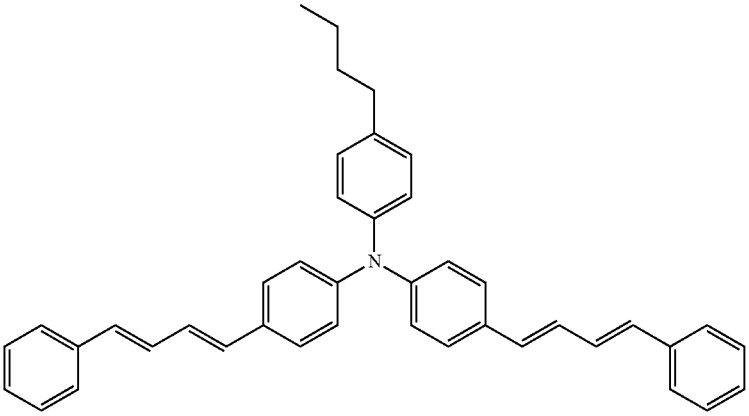

A content of the hole transporting material with respect to the total solid content of the photoconductive layer may be 20 mass % or more and 45 mass % or less, preferably 34 mass % or more and 44 mass % or less, more preferably 38 mass % or more and 44 mass % or less, and still more preferably 38 mass % or more and 42 mass % or less, from the viewpoints of a high light sensitivity and prevention of occurrence of black spots.

Further, from the viewpoints of the high light sensitivity and the prevention of the occurrence of the black spots, a mass ratio of the hole transporting material to the electron transporting material (a mass of the hole transporting material/a mass of the electron transporting material) is preferably 19/5 or more and 28/5 or less, more preferably 20/5 or more and 26/5 or less, and still more preferably 21/5 or more and 24/5 or less.

Electron Transporting Material

The electron transporting material is not particularly limited, and examples thereof include: a quinone-based compound such as chloranil and bromoanil; a tetracyanoquinodimethane-based compound; a fluorenone-based compound such as 2,4,7-trinitro-9-fluorenone, 2,4,5,7-tetranitro-9-fluorenone, and octyl 9-dicyanomethylene-9-fluorenone-4-carboxylate; an oxadiazole-based compound such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; a xanthone-based compound; a thiophene-based compound; a dinaphthoquinone-based compound such as 3,3'-di-tert-pentyl-dinaphthoquinone; a diphenoquinone-based compound such as 3,3'-di-tert-butyl-5,5'-dimethyldiphenoquinone and 3,3',5,5'-tetra-tert-butyl-4,4'-diphenoquinone; and a polymer having a group in the main chain or the side chain and composed of the above compounds. These electron transporting materials may be used alone or in combination of two or more thereof.

Among these, from the viewpoints of improving the wear resistance and preventing the occurrence of the color spots, the electron transporting material is preferably an electron transporting material having a diphenoquinone skeleton, and more preferably an electron transporting material represented by the following general formula (FK).

(FK)

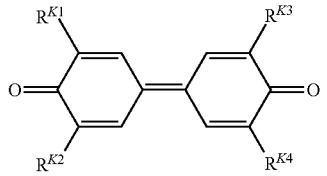

In the general formula (FK), $R^{k1}$ to $R^{k4}$ each independently represent a hydrogen atom, an alkyl group having 1 or more and 12 or less carbon atoms, an alkoxy group having 1 or more and 12 or less carbon atoms, a cycloalkyl group, an aryl group, or an aralkyl group. $R^{k1}$ is preferably a group different from at least one of $R^{k2}$ to $R^{k4}$.

From the viewpoint of preventing cracking of the photoconductive layer due to crystallization of the electron transporting material, $R^{k1}$ and $R^{k3}$ are each independently preferably an alkyl group having 3 or more and 12 or less carbon atoms, an alkoxy group having 3 or more and 12 or less carbon atoms, a cycloalkyl group, an aryl group, or an aralkyl group, more preferably a branched alkyl group having 3 or more and 12 or less carbon atoms, a branched alkoxy group having 3 or more and 12 or less carbon atoms, a cycloalkyl group, an aryl group, or an aralkyl group, still more preferably a branched alkyl group having 3 or more and 8 or less carbon atoms or a branched alkoxy group having 3 or more and 8 or less carbon atoms, and particularly preferably a t-butyl group.

Further, $R^{k1}$ and $R^{k3}$ are preferably the same group.

$R^{k2}$ and $R^{k4}$ are each independently preferably a hydrogen atom, an alkyl group having 1 or more and 8 or less carbon atoms, or an alkoxy group having 1 or more and 8 or less carbon atoms, more preferably a hydrogen atom, a linear alkyl group having 1 or more and 4 or less carbon atoms, or a linear alkoxy group having 1 or more and 4 or less carbon atoms, still more preferably a linear alkyl group having 1 or more and 3 or less carbon atoms or a linear alkoxy group having 1 or more and 3 or less carbon atoms, and particularly preferably a methyl group.

Further, $R^{k2}$ and $R^{k4}$ are preferably the same group.

Furthermore, $R^{k1}$ and $R^{k2}$ are preferably different groups, and $R^{k3}$ and $R^{k4}$ are preferably different groups.

Hereinafter, exemplified compounds 1 to 7 exemplified by $R^{k1}$ to $R^{k4}$ of the electron transporting material represented by the general formula (FK) are shown, but the electron transporting material represented by the general formula (FK) is not limited the exemplified compounds 1 to 7. An exemplified compound represented by each of the following numbers is also referred to as the "exemplified compound (1-number)". Specifically, for example, the "exemplified compound 5" is also referred to as the "exemplified compound (1-5)".

| Exemplified Compound | $R^{k1}$ | $R^{k2}$ | $R^{k3}$ | $R^{k4}$ |
|---|---|---|---|---|
| 1 | t-$C_4H_9$ | $CH_3$ | t-$C_4H_9$ | $CH_3$ |
| 2 | t-$C_4H_9$ | H | t-$C_4H_9$ | H |
| 3 | t-$C_4H_9$ | $CH_3O$ | t-$C_4H_9$ | $CH_3O$ |
| 4 | t-$C_4H_9O$ | $CH_3$ | t-$C_4H_9O$ | $CH_3$ |
| 5 | c-$C_6H_{11}$ | $CH_3$ | c-$C_6H_{11}$ | $CH_3$ |
| 6 | $C_6H_5$ | $CH_3$ | $C_6H_5$ | $CH_3$ |
| 7 | $C_6H_5CH_2$ | $CH_3$ | C6$H_5CH_2$ | $CH_3$ |

Abbreviations and the like in the above exemplified compounds indicate the following meanings.

t-$C_4H_9$: t-butyl group $CH_3O$: methoxy group t-$C_4H_9O$: t-butoxy group c-$C_6H_{11}$: cyclohexyl group $C_6H_5$: phenyl group $C_6H_5CH_2$: benzyl group A content of the electron transporting material with respect to the total solid content of the photoconductive layer is preferably 4 mass % or more and 20 mass % or less, more preferably 6 mass % or more and 18 mass % or less, and still more preferably 8 mass % or more and 16 mass % or less.

Other Additives

The single-layer-type photoconductive layer may contain other well-known additives such as an antioxidant, a light stabilizer, and a thermal stabilizer. Further, when the single-layer-type photoconductive layer serves as a surface layer, the single-layer-type photoconductive layer may contain fluorine resin particles, silicone oil, or the like.

Formation of Single-Layer-Type Photoconductive Layer

The single-layer-type photoconductive layer is formed using a photoconductive layer-forming coating liquid in which the above components are added to a solvent.

Examples of the solvent include ordinary organic solvents such as aromatic hydrocarbons such as benzene, toluene, xylene, and chlorobenzene, ketones such as acetone and 2-butanone, halogenated aliphatic hydrocarbons such as methylene chloride, chloroform, and ethylene chloride, and cyclic or linear ethers such as tetrahydrofuran and ethyl ether. These solvents are used alone or in combination of two or more thereof.

As a method for dispersing particles (for example, the charge generating material) in the photoconductive layer-forming coating liquid, a media disperser such as a ball mill, a vibration ball mill, an attritor, a sand mill, or a horizontal sand mill, or a medialess disperser such as a stirrer, an ultrasonic disperser, a roll mill, or a high-pressure homogenizer is used. Examples of the high-pressure homogenizer include a collision type in which a dispersion liquid is dispersed by liquid-liquid collision or liquid-wall collision in a high-pressure state, and a penetration type in which a dispersion liquid is dispersed by penetrating a fine flow path in a high-pressure state.

Examples of a method for coating the photoconductive layer-forming coating liquid onto the undercoat layer include a dip coating method, a push-up coating method, a wire bar coating method, a spray coating method, a blade coating method, a knife coating method, and a curtain coating method.

A film thickness of the single-layer-type photoconductive layer is preferably set in a range of 5 μm or more and 60 μm or less, more preferably 5 μm or more and 50 μm or less, and still more preferably 10 μm or more and 40 μm or less.

Image Forming Apparatus (and Process Cartridge)

The image forming apparatus according to the present exemplary embodiment includes: an electrophotographic photoconductor; a charging device configured to charge a surface of the electrophotographic photoconductor; an electrostatic latent image forming device configured to form an electrostatic latent image on the charged surface of the electrophotographic photoconductor; a developing device configured to develop, by using a developer containing a toner, the electrostatic latent image formed on the surface of the electrophotographic photoconductor so as to form a toner image; and a transfer device configured to transfer the toner image onto a surface of a recording medium. As the electrophotographic photoconductor, the above electrophotographic photoconductor according to the present exemplary embodiment is used.

The image forming apparatus according to the present exemplary embodiment is applied to a well-known image forming apparatus such as: an apparatus including a fixing device that fixes a toner image transferred to a surface of a recording medium; a direct transfer type apparatus that directly transfers a toner image formed on a surface of an electrophotographic photoconductor onto a recording medium; an intermediate transfer type apparatus that primarily transfers a toner image formed on a surface of an electrophotographic photoconductor onto a surface of an intermediate transfer body and secondarily transfers the toner image transferred to the surface of the intermediate transfer body onto a surface of a recording medium; an apparatus including a cleaning device that cleans a surface of an electrophotographic photoconductor after transfer of a toner image and before charging; an apparatus including an discharging device that irradiates a surface of an electrophotographic photoconductor with a discharging light for discharging after transfer of a toner image and before charging; and an apparatus including an electrophotographic photoconductor heating member for increasing a temperature of an electrophotographic photoconductor and reducing a relative humidity.

In the case of an intermediate transfer type apparatus, the transfer apparatus includes, for example, an intermediate transfer body on which a toner image is transferred to a surface, a primary transfer device that primarily transfers the toner image formed on a surface of an electrophotographic photoconductor onto the surface of the intermediate transfer body, and a secondary transfer device that secondarily transfers the toner image transferred on the surface of the intermediate transfer body onto a surface of a recording medium.

The image forming apparatus according to the present exemplary embodiment may be either a dry developing type image forming apparatus or a wet developing type (specifically, development type using a liquid developer) image forming apparatus.

In the image forming apparatus according to the present exemplary embodiment, for example, a portion including the electrophotographic photoconductor may be a cartridge structure (so-called process cartridge) that is attached to and detached from the image forming apparatus. As the process cartridge, for example, a process cartridge including the electrophotographic photoconductor according to the present exemplary embodiment is suitably used. In addition to the electrophotographic photoconductor, the process cartridge may include, for example, at least one selected from the group consisting of a charging device, an electrostatic latent image forming device, a developing device, and a transfer device.

Hereinafter, an example of the image forming apparatus according to the present exemplary embodiment will be described, but the image forming apparatus is not limited thereto. Main parts shown in the drawings will be described, and descriptions of other parts will be omitted.

Figure 2:
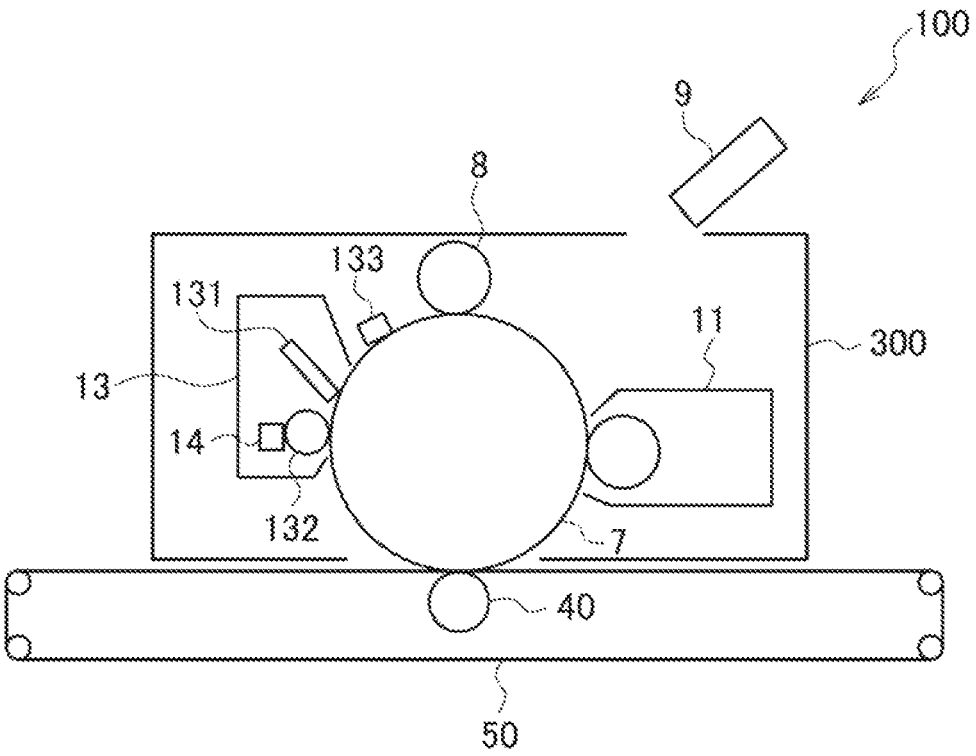
FIG. 2 is a schematic configuration diagram illustrating an example of an image forming apparatus according to the present exemplary embodiment.

FIG. 2 is a schematic configuration diagram illustrating an example of the image forming apparatus according to the present exemplary embodiment.

As shown in FIG. 2, an image forming apparatus 100 according to the present exemplary embodiment includes a process cartridge 300 including an electrophotographic photoconductor 7, an exposure device 9 (an example of the electrostatic latent image forming device), and a transfer device 40 (an example of the transfer device). In the image forming apparatus 100, the exposure device 9 is disposed at a position where the electrophotographic photoconductor 7 may be exposed from an opening of the process cartridge 300, and the transfer device 40 is disposed at a position facing the electrophotographic photoconductor 7 via a recording medium transport belt 50.

The process cartridge 300 shown in FIG. 2 integrally supports, in a housing, the electrophotographic photoconductor 7, a charging device 8 (an example of the charging device), a developing device 11 (an example of the developing device), and a cleaning device 13 (an example of a cleaning device). The cleaning device 13 includes a cleaning blade 131 (an example of a cleaning member), and the cleaning blade 131 is disposed to be in contact with a surface of the electrophotographic photoconductor 7. The cleaning member may be a conductive or insulating fibrous member or a cleaning roll made of foamed resin instead of the form of the cleaning blade 131, and may be used alone or in combination with the cleaning blade 131.

FIG. 2 shows an example in which the image forming apparatus includes a fibrous member 132 (in roll shape) that supplies a lubricant 14 to the surface of the electrophotographic photoconductor 7, and a fibrous member 133 (in flat brush shape) that assists the cleaning, but these members are disposed as necessary.

Hereinafter, each configuration of the image forming apparatus according to the present exemplary embodiment will be described.

Charging Device

As the charging device 8, for example, a contact type charger using a conductive or semiconductive charging roller, a charging brush, a charging film, a charging rubber blade, or a charging tube is used. Further, a charger, which is well known per se, such as a non-contact type roller charger, and a scorotron charger or a corotron charger using corona discharge, is also used.

Exposure Device

Examples of the exposure device 9 include an optical device that exposes the surface of the electrophotographic photoconductor 7 with a light such as a semiconductor laser light, an LED light, or a liquid crystal shutter light in a predetermined image pattern. A wavelength of the light source is within a spectral sensitivity range of the electrophotographic photoconductor. A mainstream wavelength of a semiconductor laser is near infrared, which has an oscillation wavelength in the vicinity of 780 nm. However, the present invention is not limited to this wavelength, and a laser having an oscillation wavelength of about 600 nm or a blue laser having an oscillation wavelength of 400 nm or more and 450 nm or less also may be used. Further, in order to form a color image, a surface emitting type laser light source capable of outputting a multiple beam is also effective.

Developing Device

Examples of the developing device 11 include a general developing device in which a developer is used in a contact or non-contact manner to perform developing. The developing device 11 is not particularly limited as long as the above function is provided, and is selected according to a purpose. Examples thereof include a well-known developing device provided with a function of attaching a one-component developer or a two-component developer to the electrophotographic photoconductor 7 using a brush, a roller, or the like.

Among these, the developing device 11 is preferably a device including a developing roll that holds a developer and transports the developer to a developing region (for example, an area facing the electrophotographic photoconductor).

In particular, in the developing device 11, an absolute value of a difference in Young's modulus between a photoconductive layer of the electrophotographic photoconductor and a surface of a developing roll is preferably 3000 or more and 6000 or less, more preferably 3500 or more and 5000 or less, and still more preferably 4000 or more and 4600 or less.

When the absolute value of the difference in Young's modulus between the photoconductive layer (specifically, the surface the photoconductive layer) of the electrophotographic photoconductor and the surface of the developing roll is 3785 or more and 4675 or less, the photoconductive layer is appropriately worn by the developing roll, the adhesive materials (paper debris or the like) is easily cleaned, and the occurrence of the color spots is further prevented while preventing the wear.

The Young's modulus of the surface of the developing roll is preferably 110 MPa or more and 210 MPa or less, and more preferably 150 MPa or more and 170 MPa or less, from the viewpoints of improving the wear resistance and preventing the occurrence of the color spots.

The developing roll includes, for example, a cylindrical developing sleeve (for example, a metal cylindrical tube, a ceramic cylindrical tube, or a resin cylindrical tube) that is rotatably disposed, and a magnet roll disposed inside the developing sleeve. Further, an elastic body layer made of an oil-resistant rubber or the like may be provided on a metal roller base body, and a conductive layer may be provided on the elastic body layer.

The Young's modulus of the surface of the developing roll may be adjusted according to a material of a member of an outermost layer. In order to make the Young's modulus of the surface of the developing roll fall within the above range, a developing roll including an elastic body layer and a conductive layer on a metal roller base body may be adopted.

The Young's modulus of the surface of the developing roll is measured in the same manner as the method for measuring the Young's modulus of the photoconductive layer.

The developer used in the developing device 11 may be a one-component developer using only a toner or a two-component developer containing a toner and a carrier. Further, the developer may be magnetic or non-magnetic. As these developers, well-known developers are used.

Cleaning Device

As the cleaning device 13, a cleaning blade type device including the cleaning blade 131 is used.

In addition to the cleaning blade type, a fur brush cleaning type or a simultaneous development cleaning type may be adopted.

Transfer Device

Examples of the transfer device 40 include a transfer charger, which is well known per se, such as a contact type transfer charger using a belt, a roller, a film, a rubber blade, or the like, and a scorotron transfer charger or a corotron transfer charger using corona discharge.

Recording Medium Transport Belt

As the recording medium transport belt 50, a belt-shaped one (so-called intermediate transfer belt) containing semiconductive polyimide, polyamideimide, polycarbonate, polyarylate, polyester, rubber, and the like is used.

Figure 3:
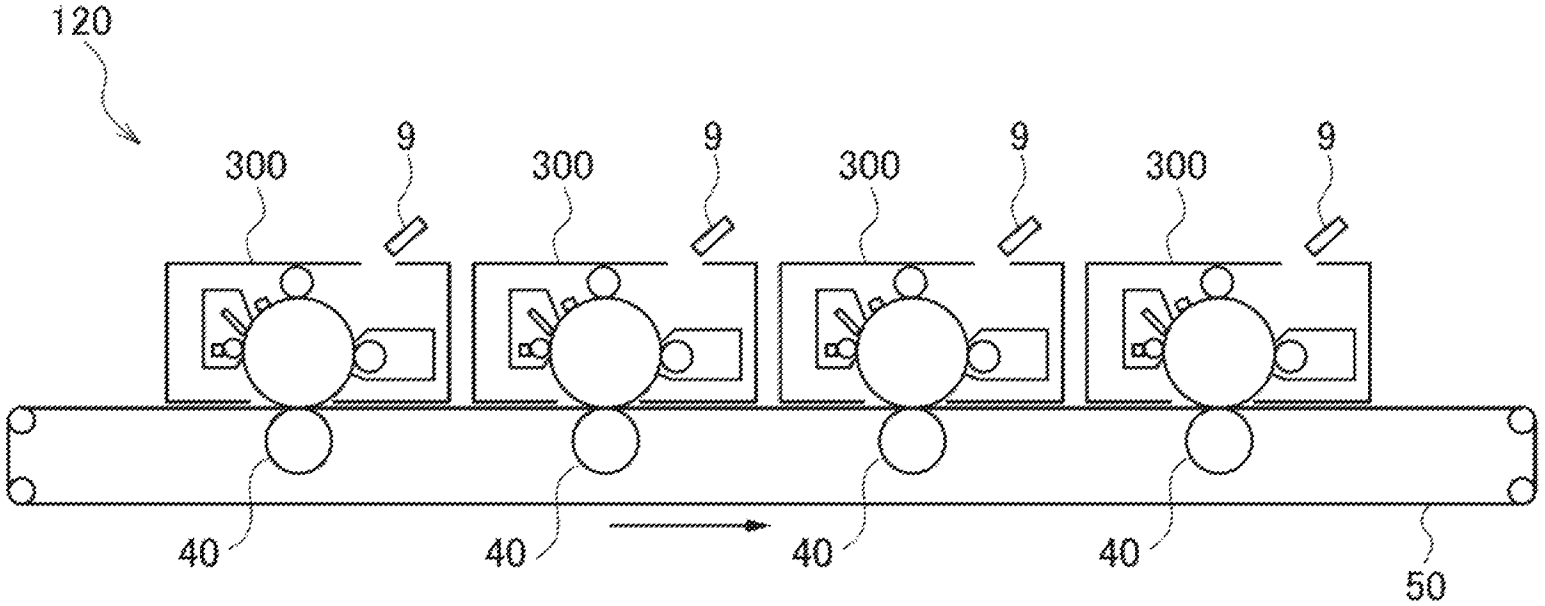
FIG. 3 is a schematic configuration diagram illustrating another example of the image forming apparatus according to the present exemplary embodiment.

FIG. 3 is a schematic configuration diagram illustrating another example of the image forming apparatus according to the present exemplary embodiment.

An image forming apparatus 120 shown in FIG. 3 is a tandem type multicolor image forming apparatus in which four process cartridges 300 are mounted. In the image forming apparatus 120, four process cartridges 300 are arranged in parallel on an intermediate transfer body 50, and one electrophotographic photoconductor is used for one color. The image forming apparatus 120 has the same configuration as that of the image forming apparatus 100 except that the image forming apparatus 120 is of a tandem type.

EXAMPLES

Hereinafter, the present invention will be described more specifically based on Examples and Comparative Examples, but the present invention is not limited to the following Examples at all. Unless otherwise specified, "part" indicates "part by mass", and "%" indicates "mass %".

Examples 1 to 21 and Comparative Examples 1 to 6

Production of Photoconductive Layer-Forming Coating Liquid

A photoconductive layer-forming coating liquid is obtained by dispersing, in a high-pressure homogenizer, a mixture of a binder resin shown in Table 1, a charge generating material shown in Table 1 ("CGM" in Table 1), a hole transporting material shown in Table 1 ("HTM" in Table 1), an electron transporting material shown in Table 1

("ETM" in Table 1), and tetrahydrofuran in an amount corresponding to a solid content concentration shown in Table 1.

Formation of Photoconductive Layer

As a conductive substrate, an aluminum substrate having a diameter of 30 mm, a length of 244.5 mm, and a thickness of 0.75 mm is prepared.

Next, under photoconductive layer forming conditions shown in Table 1, the photoconductive layer-forming coating liquid is coated onto the aluminum substrate using a dip coating method, and dried and cured to form a single-layer-type photoconductive layer having a thickness of 35 μm on the aluminum substrate.

In this way, a photoconductor of each Example is obtained.

Characteristics

The following characteristics of the photoconductor of each Example are measured according to the methods described above.

Martens hardness of the photoconductive layer

Young's modulus of the photoconductive layer

Elastic deformation ratio of the photoconductive layer

Evaluations

The following evaluations are carried out using the photoconductor of each Example.

Wear Amount

The photoconductor of each Example is mounted on an image forming apparatus "HL-L6400DW manufactured by Brother Industries, Ltd". However, a Young's modulus of each developing roll is set as shown in Table 2 by changing a material of a developing sleeve.

Then, 20,000 sheets of 50% halftone images are printed on A4 paper by the image forming apparatus.

Then, a film thickness of the photoconductive layer before mounting and a film thickness of the photoconductive layer after printing are measured by an eddy current type film thickness meter, and a difference thereof is calculated as a wear amount. When the wear amount is 3 μm or more, it is determined that the wear resistance is low.

Color Spots

Image Quality Evaluation

The 20,000th 50% halftone image printed in the above evaluation of the wear amount is observed, and an occurrence state of color spots is evaluated according to the following criteria.

As a developing roll of the image forming apparatus, a developing roll whose surface Young's modulus is shown in Table 2 is adopted.

5: Very good (no color spot)
4: Good (almost no color spot)
3: Normal (some color spots are found but acceptable)
2: Bad (color spots are found and unacceptable)
1: Very bad (many color spots are found and unacceptable)

When the evaluation is 2 or less, it is evaluated that a problem may occur in practical use.

TABLE 1

| | Photoconductive layer-forming coating liquid | | | | | | | | | | | Photoconductive layer forming condition | | | |
|---|---|---|---|---|---|---|---|---|---|---|---|---|---|---|---|
| | Binder resin | | | CGM | | HTM | | ETM | | HTM/ETM amount ratio | Solid content concentration (%) | Coating liquid temperature (° C.) | Room temperature (° C.) | Drying Temperature (° C.) | Time (min) |
| | Type (mass ratio) | Mw | Part | Type | Part | Type | Part | Type | Part | | | | | | |
| Example 1 | PCZ | 20000 | 53 | CGM-A | 1 | HTM-A | 39 | ETM-A | 7 | 5.6 | 32 | 24 | 24 | 115 | 24 |
| Example 2 | BPZ/PCZ (=7/3) | 50000/30000 | 51 | CGM-A | 1 | HTM-B | 40 | ETM-A | 8 | 5.0 | 26 | 24 | 24 | 115 | 24 |
| Example 3 | BPZ/PCZ (=3/7) | 50000/30000 | 49 | CGM-A | 1 | HTM-B | 42 | ETM-A | 8 | 5.3 | 22 | 24 | 24 | 115 | 24 |
| Example 4 | BPZ/PCZ (=5/5) | 50000/30000 | 51 | CGM-A | 1 | HTM-A | 40 | ETM-A | 8 | 5.0 | 24 | 24 | 24 | 115 | 24 |
| Example 5 | BPZ/PCZ (=6/4) | 50000/20000 | 51 | CGM-A | 1 | HTM-B | 39 | ETM-B | 9 | 4.3 | 20 | 24 | 24 | 115 | 24 |
| Example 6 | BPZ/PCZ (=6/4) | 50000/30000 | 51 | CGM-A | 1 | HTM-A | 39 | ETM-A | 9 | 4.3 | 20 | 24 | 24 | 115 | 24 |
| Example 7 | BPZ/PCZ (=4/6) | 50000/30000 | 48 | CGM-A | 1 | HTM-A | 42 | ETM-A | 9 | 4.7 | 22 | 24 | 24 | 115 | 24 |
| Example 8 | BPZ/PCZ (=4/6) | 50000/40000 | 48 | CGM-A | 1 | HTM-A | 42 | ETM-A | 9 | 4.7 | 22 | 24 | 24 | 115 | 24 |
| Example 9 | BPZ/PCZ (=4/6) | 50000/30000 | 47 | CGM-A | 1 | HTM-A | 40 | ETM-A | 12 | 3.3 | 22 | 24 | 24 | 115 | 24 |
| Example 10 | BPZ/PCZ (=6/4) | 50000/30000 | 49 | CGM-A | 1 | HTM-A | 39.5 | ETM-A | 10.5 | 3.8 | 20 | 24 | 24 | 115 | 24 |
| Example 11 | BPZ/PCZ (=6/4) | 50000/30000 | 53 | CGM-A | 1 | HTM-A | 39 | ETM-A | 7 | 5.6 | 20 | 24 | 24 | 115 | 24 |
| Example 12 | BPZ/PCZ (=6/4) | 50000/30000 | 52 | CGM-A | 1 | HTM-A | 40 | ETM-A | 7 | 5.7 | 20 | 24 | 24 | 115 | 24 |

TABLE 1-continued

| | Photoconductive layer-forming coating liquid | | | | | | | | | | | Photoconductive layer forming condition | | | |
|---|---|---|---|---|---|---|---|---|---|---|---|---|---|---|---|
| | Binder resin | | | CGM | | HTM | | ETM | | HTM/ ETM amount | Solid content concen-tration | Coat-ing liquid temp-erature | Room temp-erature | Drying Temp-erature | Time |
| | Type (mass ratio) | Mw | Part | Type | Part | Type | Part | Type | Part | ratio | (%) | (° C.) | (° C.) | (° C.) | (min) |
| Example 13 | BPZ/PCZ (=6/4) | 50000/ 30000 | 54 | CGM-A | 1 | HTM-A | 36 | ETM-A | 9 | 4 | 20 | 24 | 24 | 115 | 24 |
| Example 14 | BPZ/PCZ (=6/4) | 50000/ 30000 | 52 | CGM-A | 1 | HTM-A | 38 | ETM-A | 9 | 4.2 | 20 | 24 | 24 | 115 | 24 |
| Example 15 | BPZ/PCZ (=6/4) | 50000/ 30000 | 48 | CGM-A | 1 | HTM-A | 44 | ETM-A | 7 | 6.3 | 20 | 24 | 24 | 115 | 24 |
| Example 16 | BPZ/PCZ (=6/4) | 50000/ 30000 | 47 | CGM-A | 1 | HTM-A | 45 | ETM-A | 7 | 6.4 | 20 | 24 | 24 | 115 | 24 |
| Example 17 | PCZ | 80000 | 51 | CGM-A | 1 | HTM-A | 40 | ETM-A | 8 | 5.0 | 27 | 24 | 24 | 115 | 24 |
| Example 18 | PCZ | 80000 | 51 | CGM-A | 1 | HTM-A | 40 | ETM-A | 8 | 5.0 | 27 | 24 | 24 | 115 | 24 |
| Example 19 | BPZ/PCZ (=3/7) | 50000/ 20000 | 48 | CGM-A | 1 | HTM-B | 42 | ETM-B | 9 | 4.7 | 20 | 24 | 24 | 115 | 24 |
| Example 20 | BPZ/PCZ (=3/7) | 50000/ 20000 | 48 | CGM-A | 1 | HTM-B | 42 | ETM-B | 9 | 4.7 | 20 | 24 | 24 | 115 | 24 |
| Example 21 | PA | 50000 | 48 | CGM-A | 1 | HTM-A | 42 | ETM-A | 9 | 4.7 | 20 | 24 | 24 | 115 | 24 |
| Comparative Example 1 | BPZ | 50000 | 51 | CGM-A | 1 | HTM-A | 40 | ETM-A | 8 | 5.0 | 18 | 24 | 24 | 115 | 24 |
| Comparative Example 2 | BPZ/PCZ (=2/8) | 50000/ 30000 | 50 | CGM-A | 1 | HTM-B | 40 | ETM-A | 9 | 4.4 | 27 | 24 | 24 | 115 | 24 |
| Comparative Example 3 | BPZ/PCZ (=2/8) | 50000/ 30000 | 50 | CGM-A | 1 | HTM-B | 40 | ETM-B | 9 | 4.4 | 27 | 24 | 24 | 115 | 24 |
| Comparative Example 4 | BPZ/PCZ (=6/4) | 50000/ 30000 | 51 | CGM-A | 1 | HTM-B | 39 | ETM-C | 9 | 4.3 | 27 | 24 | 24 | 115 | 24 |
| Comparative Example 5 | BPZ/PCZ (=2/8) | 50000/ 30000 | 50 | CGM-A | 1 | HTM-A | 40 | ETM-A | 9 | 4.4 | 27 | 24 | 24 | 115 | 24 |
| Comparative Example 6 | PCZ | 80000 | 51 | CGM-A | 1 | HTM-A | 40 | ETM-A | 8 | 5 | 23 | 24 | 24 | 115 | 24 |

TABLE 2

| | Photoconductive layer | | | | Developing roll | Difference in Young's | Evaluation | |
|---|---|---|---|---|---|---|---|---|
| | Martens hardness M ($N/mm^2$) | Young's modulus F (MPa) | Elastic deformation ratio μ (%) | Index A | Young's modulus (MPa) | modulus between photoconductor and developing roll (MPa) | Wear amount (μm) | Color spots |
| Example 1 | 186.20 | 3979.62 | 41.98 | −7.93 | 160 | 3820 | 2.8 | 3 |
| Example 2 | 217.20 | 4617.89 | 44.14 | −7.98 | 139 | 4479 | 2.4 | 5 |
| Example 3 | 228.60 | 4613.59 | 43.98 | −7.28 | 180 | 4434 | 2.9 | 3 |
| Example 4 | 210.79 | 4520.44 | 42.17 | −7.65 | 165 | 4355 | 2.7 | 5 |
| Example 5 | 226.61 | 4813.93 | 44.03 | −7.81 | 165 | 4649 | 2.4 | 3 |
| Example 6 | 201.68 | 4123.37 | 43.86 | −7.80 | 165 | 3958 | 2.5 | 5 |
| Example 7 | 227.60 | 4613.59 | 43.98 | −7.34 | 165 | 4449 | 2.6 | 4 |
| Example 8 | 222.56 | 4610.33 | 42.98 | −7.37 | 165 | 4445 | 2.6 | 3 |
| Example 9 | 189.88 | 4280.04 | 39.90 | −7.79 | 165 | 4115 | 2.7 | 4 |
| Example 10 | 210.79 | 4520.44 | 42.17 | −7.65 | 165 | 4355 | 2.4 | 5 |
| Example 11 | 222.63 | 4582.21 | 44.42 | −7.67 | 165 | 4417 | 2.4 | 5 |
| Example 12 | 228.60 | 4613.59 | 43.98 | −7.28 | 165 | 4449 | 2.4 | 3 |
| Example 13 | 210.46 | 4426.99 | 41.43 | −7.30 | 165 | 4262 | 2.3 | 3 |
| Example 14 | 209.31 | 4425.96 | 41.43 | −7.36 | 165 | 4261 | 2.3 | 3 |
| Example 15 | 222.62 | 4720.94 | 43.61 | −7.74 | 165 | 4556 | 2.4 | 4 |
| Example 16 | 222.54 | 4730.13 | 43.62 | −7.77 | 165 | 4565 | 2.4 | 4 |
| Example 17 | 186.10 | 3949.59 | 42.35 | −7.96 | 180 | 3770 | 2.2 | 3 |
| Example 18 | 186.10 | 3949.59 | 42.35 | −7.96 | 165 | 3785 | 2.1 | 3 |
| Example 19 | 226.61 | 4813.93 | 44.03 | −7.81 | 139 | 4675 | 2.3 | 3 |
| Example 20 | 226.61 | 4813.93 | 44.03 | −7.81 | 116 | 4698 | 2.3 | 3 |
| Example 21 | 201.59 | 3467.21 | 49.18 | −7.84 | 165 | 3302 | 2.8 | 3 |
| Comparative Example 1 | 190.00 | 4205.61 | 42.74 | −8.35 | 165 | 4041 | 1.8 | 2 |
| Comparative Example 2 | 198.57 | 3967.97 | 42.26 | −7.27 | 165 | 3803 | 3.1 | 1 |
| Comparative Example 3 | 220.46 | 4426.99 | 42.52 | −7.00 | 165 | 4262 | 3.0 | 1 |

TABLE 2-continued

| | Photoconductive layer | | | | Developing roll | Difference in Young's | Evaluation | |
|---|---|---|---|---|---|---|---|---|
| | Martens hardness M ($N/mm^2$) | Young's modulus F (MPa) | Elastic deformation ratio μ (%) | Index A | Young's modulus (MPa) | modulus between photoconductor and developing roll (MPa) | Wear amount (μm) | Color spots |
| Comparative Example 4 | 203.11 | 4321.59 | 39.93 | −7.13 | 165 | 4157 | 3.2 | 1 |
| Comparative Example 5 | 198.57 | 3967.97 | 42.26 | −7.27 | 116 | 3852 | 2.9 | 2 |
| Comparative Example 6 | 185.15 | 3916.18 | 42.62 | −8.02 | 165 | 3751 | 1.9 | 2 |

From the above results, it can be seen that the photoconductors of Examples prevent occurrence of color spots while reducing wear of photoconductive layers as compared with the photoconductors of Comparative Examples.

Abbreviations in Table 1 mean the following compounds.

Binder Resin

PCZ: a homopolymerization type polycarbonate resin having the structural unit represented by (PCB-1) (weight average molecular weight Mw is described in Table 1)

BPZ: a copolymerization type polycarbonate resin having the structural unit represented by (PC-1) (pm: 25, pn: 75, weight average molecular weight Mw is described in Table 1)

PA: a polyarylate resin containing a structural unit represented by the following formula (weight average molecular weight Mw is described in Table 1)

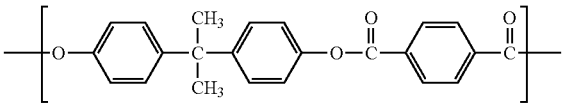

Charge Generating Material

CGM-A: V-type hydroxygallium phthalocyanine having diffraction peaks at Bragg angles (2θ±0.2°) of at least 7.3°, 16.0°, 24.9°, and 28.0° in an X-ray diffraction spectrum using CuKα characteristic X-rays, a maximum peak wavelength of 820 nm in a spectral absorption spectrum in a wavelength region of 600 nm to 900 nm, an average particle diameter of 0.12 μm, a maximum particle diameter of 0.2 μm, and a BET specific surface area of 60 $m^2/g$ Hole Transporting Material HTM-A: a compound having the following structure, the exemplified compound (HT1-1) of the hole transporting material represented by the general formula (HT1a), that is, N,N'-diphenyl-N,N'-bis(3-methylphenyl)-[1,1']biphenyl-4,4'-diamine

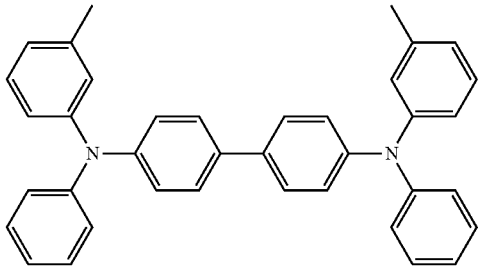

HTM-B: a compound having the following structure

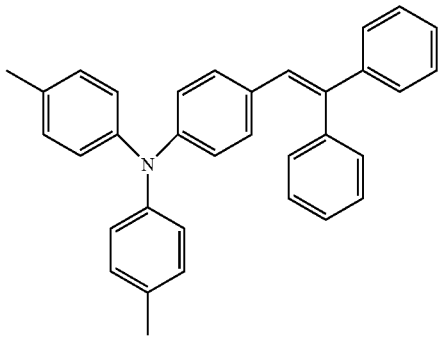

Electron Transporting Material

ETM-A: a compound having the following structure, the exemplified compound (1-1) of the electron transporting material represented by the general formula (FK), that is, 3,3'-di-tert-butyl-5,5'-dimethyldiphenoquinone.

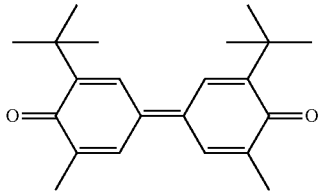

ETM-B: a compound having the following structure

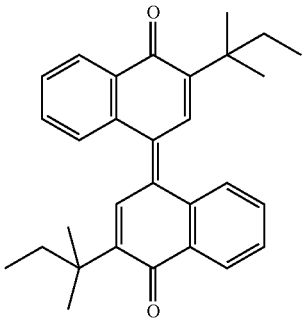

ETM-C: a compound having the following structure

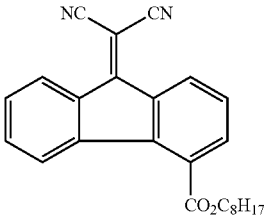

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:

a conductive substrate; and a single-layer-type photoconductive layer that is provided on the conductive substrate, contains a binder resin, a charge generating material, a hole transporting material, and an electron transporting material, and has an index A represented by the following equation (1) in a range of −7.98 or more and −7.28 or less, $$A=(0.057\times M)-(0.002\times F)-(0.252\times\mu) \quad \text{Equation (1):}$$

wherein, in the equation (1), M represents a Martens hardness of the single-layer-type photoconductive layer, F represents a Young's modulus of the single-layer-type photoconductive layer, and μ represents an elastic deformation ratio of the single-layer-type photoconductive layer, wherein a content of the hole transporting material with respect to a total solid content of the single-layer type photoconductive layer is 38 mass % or more and 44 mass % or less, and wherein the binder resin is a polycarbonate resin containing at least one of a structural unit represented by the following general formula (PCA) and a structural unit represented by the following general formula (PCB), (PCA)

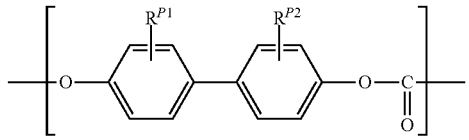

(PCB)

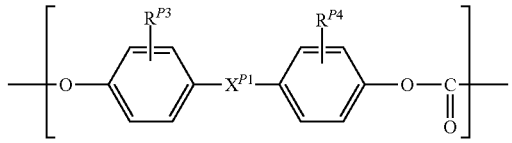

wherein, in the general formulas (PCA) and (PCB), $R^{P1}$, $R^{P2}$, $R^{P3}$, and $R^{P4}$ each independently represent a hydrogen atom, a halogen atom, an alkyl group having 1 or more and 6 or less carbon atoms, a cycloalkyl group having 5 or more and 7 or less carbon atoms, or an aryl group having 6 or more and 12 or less carbon atoms, and $X^{P1}$ represents a phenylene group, a biphenylene group, a naphthylene group, an alkylene group, or a cycloalkylene group.

2. The electrophotographic photoconductor according to claim 1, wherein the index A is in a range of −7.80 or more and −7.34 or less.

3. The electrophotographic photoconductor according to claim 1, wherein a mass ratio of the hole transporting material to the electron transporting material is 19/5 or more and 28/5 or less.

4. The electrophotographic photoconductor according to claim 2, wherein a mass ratio of the hole transporting material to the electron transporting material is 19/5 or more and 28/5 or less.

5. The electrophotographic photoconductor according to claim 1, wherein the hole transporting material is a hole transporting material having a benzidine skeleton.

6. The electrophotographic photoconductor according to claim 2, wherein the hole transporting material is a hole transporting material having a benzidine skeleton.

7. The electrophotographic photoconductor according to claim 3, wherein the hole transporting material is a hole transporting material having a benzidine skeleton.

8. The electrophotographic photoconductor according to claim 4, wherein the hole transporting material is a hole transporting material having a benzidine skeleton.

9. The electrophotographic photoconductor according to claim 5, wherein the hole transporting material having the benzidine skeleton is a hole transporting material represented by the following general formula (HT1a), (HT1a)

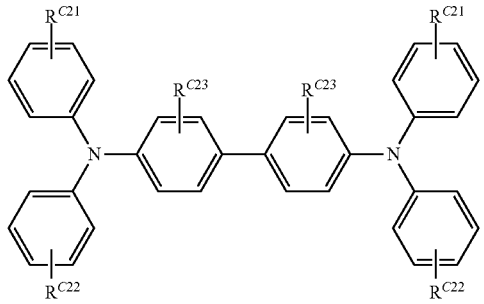

wherein, in the general formula (HT1a), $R^{C21}$, $R^{C22}$, and $R^{C23}$ each independently represent a hydrogen atom, a halogen atom, an alkyl group having 1 or more and 10 or less carbon atoms, an alkoxy group having 1 or more and 10 or less carbon atoms, or an aryl group having 6 or more and 10 or less carbon atoms.

10. The electrophotographic photoconductor according to claim 1, wherein the electron transporting material is an electron transporting material having a diphenoquinone skeleton.

11. The electrophotographic photoconductor according to claim 10, wherein the electron transporting material having the diphenoquinone skeleton is an electron transporting material represented by the following general formula (FK), (FK)

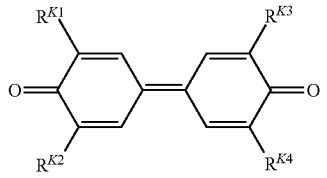

wherein, in the general formula (FK), $R^{k1}$ to $R^{k4}$ each independently represent a hydrogen atom, an alkyl group having 1 or more and 12 or less carbon atoms, an alkoxy group having 1 or more and 12 or less carbon atoms, a cycloalkyl group, an aryl group, or an aralkyl group.

12. A process cartridge comprising:

the electrophotographic photoconductor according to claim 1, wherein the process cartridge is configured to be attached to and detached from an image forming apparatus.

13. The process cartridge according to claim 12, further comprising:

a developing device configured to develop, by using a developer containing a toner, an electrostatic latent image formed on a surface of the electrophotographic photoconductor so as to form a toner image, the developing device including a developing roll configured to hold the developer and transport the developer to a developing region, wherein an absolute value of a difference in Young's modulus between the single-layer-type photoconductive layer of the electrophotographic photoconductor and a surface of the developing roll is 3785 or more and 4675 or less.

14. An image forming apparatus comprising:

the electrophotographic photoconductor according to claim 1;

a charging device configured to charge a surface of the electrophotographic photoconductor;

an electrostatic latent image forming device configured to form an electrostatic latent image on the surface of the electrophotographic photoconductor charged by the charging device;

a developing device configured to develop, by using a developer containing a toner, the electrostatic latent image formed on the surface of the electrophotographic photoconductor so as to form a toner image; and a transfer device configured to transfer the toner image onto a surface of a recording medium.

15. The image forming apparatus according to claim 14, wherein the developing device includes a developing roll configured to hold the developer and transport the developer to a developing region, and an absolute value of a difference in Young's modulus between the single-layer-type photoconductive layer of the electrophotographic photoconductor and a surface of the developing roll is 3785 or more and 4675 or less.

* * * * *